US011178476B2

(12) United States Patent
Ou

(10) Patent No.: US 11,178,476 B2
(45) Date of Patent: Nov. 16, 2021

(54) MICROPHONE MODULE

(71) Applicant: GOERTEK INC., Shandong (CN)

(72) Inventor: Mingxu Ou, Shandong (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 16/761,156

(22) PCT Filed: Sep. 27, 2018

(86) PCT No.: PCT/CN2018/107865
§ 371 (c)(1),
(2) Date: May 1, 2020

(87) PCT Pub. No.: WO2019/109715
PCT Pub. Date: Jun. 13, 2019

(65) Prior Publication Data

US 2020/0275179 A1 Aug. 27, 2020

(30) Foreign Application Priority Data

Dec. 8, 2017 (CN) ..... 201721696750.2

(51) Int. Cl.
*H04R 1/02* (2006.01)
*H04R 1/08* (2006.01)
*H04R 1/04* (2006.01)

(52) U.S. Cl.
CPC ..... *H04R 1/08* (2013.01); *H04R 1/04* (2013.01)

(58) Field of Classification Search
CPC ..... H04R 1/086; H04R 1/02; H04R 1/025; H04R 1/026
(Continued)

(56) References Cited

U.S. PATENT DOCUMENTS 2,293,078 A * 8/1942 Proctor ..... H04R 1/086 381/177
5,400,413 A * 3/1995 Kindel ..... H04R 1/023 181/199

(Continued)

*Primary Examiner* — Suhan Ni
(74) *Attorney, Agent, or Firm* — Paratus Law Group, PLLC

(57) ABSTRACT

The present invention discloses a microphone module. The module comprises: a housing having a sound receiving hole; a pressing plate fixedly combined with the housing, an accommodating cavity being formed between the inner side surface of the pressing plate and the outer side surface of the housing, and the pressing plate comprising sound transmitting hole corresponding to the sound receiving hole; and an intermediate layer covering the sound receiving hole, provided on the outer or inner side surface of the housing, and corresponding to the sound receiving hole. The housing further comprises an annular protrusion having a passage, extending outwards from the outer side surface of the housing, and surrounding the sound receiving hole. According to the microphone module provided in the present invention, by combining the sound transmitting hole with the annular protrusion having the passage, the vibration amplitude of the intermediate layer remains small even when the microphone module is subjected to high-pressure water impact, such that deformation and breaking of the intermediate layer are avoided. Therefore, the influence on the acoustic performance and waterproof performance of the microphone module is reduced.

10 Claims, 3 Drawing Sheets

(58) Field of Classification Search
USPC ..... 381/359, 391
See application file for complete search history.

(56) References Cited

U.S. PATENT DOCUMENTS 5,844,999 A * 12/1998 Kameda ..... B29C 66/542
381/386
7,677,353 B2 * 3/2010 Shinohara ..... H04R 1/288
181/150
8,374,377 B2 * 2/2013 Yamaguchi ..... H04R 1/025
381/391
8,861,753 B2 * 10/2014 Kasai ..... H04R 3/00
381/162

* cited by examiner

MICROPHONE MODULE

CROSS REFERENCE TO PRIOR APPLICATION

This application is a National Stage Patent Application of PCT International Patent Application No. PCT/CN2018/107865 (filed on Sep. 27, 2018) under 35 U.S.C. § 371, which claims priority to Chinese Patent Application No. 201721696750.2 (filed on Dec. 8, 2017), which are all hereby incorporated by reference in their entirety.

FIELD OF THE INVENTION

The present invention relates to the technical field of electronic products, in particular to a microphone module.

BACKGROUND OF THE INVENTION

Existing microphone modules usually need to have a certain waterproof ability. Current waterproof microphone modules usually have a waterproof intermediate layer or complex water outlet groove at a sound receiving hole to prevent water from entering the water receiving hole. But the cost of the above method is high. When the water pressure is high, the intermediate layer, such as a waterproof film, will be caused to be deformed or broken due to a large amplitude of pressure vibration, which influences the acoustic performance and waterproof performance of the microphone module.

Therefore, it is necessary to provide a microphone module to solve the above problem.

SUMMARY OF THE INVENTION

One purpose of the present invention is to provide a microphone module to solve the problem that, when the water pressure is large, the vibration amplitude of the intermediate layer of the existing waterproof microphone module simultaneously becomes large and causes the microphone module to be deformed or broken, which leads to the decrease of the acoustic performance and waterproof performance of the microphone module.

In order to achieve the above purpose, the present invention adopts the following technical solution.

A microphone module comprises a housing having a sound receiving hole; a pressing plate fixedly combined with the housing, an accommodating cavity being formed between the inner side surface of the pressing plate and the outer side surface of the housing, and the pressing plate comprising a sound transmitting hole corresponding to the sound receiving hole; and an intermediate layer covering the sound receiving hole, provided on the outer or inner side surface of the housing, and corresponding to the sound receiving hole, wherein the housing further comprises an annular protrusion surrounding the sound receiving hole and extending outwards from the outer side surface of the housing, and the end surface, opposite to the housing, of the annular protrusion is fit to be fixed with the inner side surface of the pressing plate; the annular protrusion divides the accommodating cavity into a first cavity formed inside the annular protrusion and a second cavity formed outside the annular protrusion; the first cavity and the second cavity are communicated with each other through a passage in the side wall of the annular protrusion; and the pressing plate further comprises a water drain hole penetrating through the inner and outer side surfaces of the pressing plate, and the water drain hole is in communication with the second cavity.

Preferably, the passage is formed by opening a through hole penetrating through the inner and outer side wall surfaces of the side wall of the annular protrusion.

Preferably, the passage consists of a notch formed in the end surface, opposite to the housing, of the annular protrusion, and the notch penetrates through the inner and outer side wall surfaces of the side wall of the annular protrusion.

Preferably, the bottom of the notch extends to the outer side surface of the housing.

Preferably, the intermediate layer is a waterproof sound transmitting film or a water absorbing medium layer.

Preferably, the pressing plate comprises a plurality of sound transmitting holes and the plurality of sound transmitting holes are correspondingly provided in an area defined by the annular protrusion.

Preferably, the water drain hole is located in the axial direction of the passage.

Preferably, the side wall of the annular protrusion has an inwards contracted structure and the surface of the inner side wall of the annular protrusion is arranged as an inclined surface.

Preferably, the water drain hole is located in the edge of the bottom of the pressing plate and the inner side wall surface of the cavity of the housing corresponding to the water drain hole is arranged as an inclined surface.

Preferably, the diameter of the sound transmitting hole is 0.1-0.15 mm.

The present invention has the following beneficial effects:

In the microphone module provided by the present invention, by combining the sound transmitting hole with the annular protrusion having the passage, when the microphone module is impacted by high-pressure water, since the pressure of the water is relieved by the sound transmitting hole, the vibration amplitude of the intermediate layer is small such that the water is prevented from impacting and destroying the intermediate layer, and the acoustic performance and waterproof performance of the module are guaranteed. At the same time, the water blocked by the intermediate layer can flow out of the module through the passage, and the said simple module design makes the microphone module have a good waterproof ability and is adapted to the needs such as water washing.

DESCRIPTION OF THE DRAWINGS

The specific embodiments of the present invention will be further described below in detail in conjunction with the accompanying drawings.

Reference signs: 1—housing, 11—annular protrusion, 12—sound receiving hole, 13—passage, 2—pressing plate, 21—sound transmitting hole, 22—water drain hole, 3—intermediate layer.

DESCRIPTION OF THE EMBODIMENTS

In order to explain the present invention more clearly, the present invention will be further described in conjunction with the preferred embodiments and the accompanying drawings. Like parts in the accompanying drawings are represented by the like reference signs. It should be understood by one skilled in the art that the contents described below are descriptive rather than restrictive and should not limit the scope of protection of the present invention.

At present, the application of electronic devices is more and more extensive, and people have higher and higher requirements on the waterproof performance of electronic devices. Therefore, as one of the common electronic devices, the microphone module usually needs to have a certain waterproof ability.

However, the current water-proof microphone modules generally adopt a water absorbing layer or a more complex water outlet groove to prevent water from entering the sound receiving hole. The manufacturing cost of these microphone modules is high. Moreover, when the pressure of water is high, the intermediate layer, such as a waterproof film, suffers from a large impacting force from the high-pressure water, which will make the vibration amplitude of the intermediate layer to be large and easily causes the microphone modules to be deformed or broken, which will influence the acoustic performance and waterproof performance of the microphone modules. In order to solve at least one of the above problems, the present invention provides a microphone module.

Figure 1:
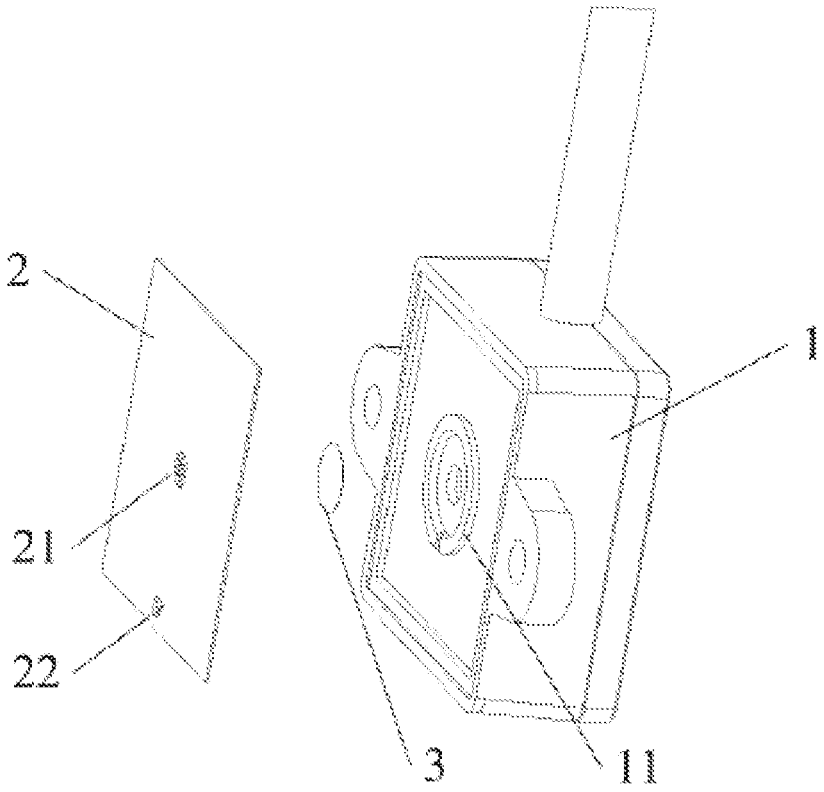
FIG. 1 illustrates a structural schematic view of a microphone module in one embodiment provided by the present invention.

Specifically, the present invention provides an embodiment. Now refer to FIG. 1 and FIG. 2, a microphone module is provided. The module comprises: a housing 1 having a sound receiving hole 12; a pressing plate 2 fixedly combined with the housing 1, an accommodating cavity being formed between the inner side surface of the pressing plate 2 and the outer side surface of the housing 1, and the pressing plate 2 comprising a sound transmitting hole 21 corresponding to the sound receiving hole 12, of course, in order to disperse the water pressure and decrease the influence on sound transmission, a plurality of sound transmitting holes 21 may be provided, and the plurality of sound transmitting holes 21 are correspondingly provided in an area defined by he annular protrusion 11; and an intermediate layer 3 covering the sound receiving hole 12 and corresponding to the sound receiving hole 12 is provided on the outer or inner side surface of the housing 1, the housing 1 further comprises an annular protrusion 11 surrounding the sound receiving hole 12 and extending outwards from the outer side surface of the housing 1, and the end surface, opposite to the housing 1, of the annular protrusion 11 is fit with the inner side surface of the pressing plate 2 and fixed thereon; the annular protrusion 11 divides the accommodating cavity into a first cavity formed inside the annular protrusion 11 and a second cavity formed outside the annular protrusion 11; the first cavity and the second cavity are communicated with each other through a passage 13 in the side wall of the annular protrusion 11; and the pressing plate 2 further comprises a water drain hole 22 penetrating through the inner and outer side surfaces of the pressing plate 2, and the water drain hole 22 is in communication with the second cavity.

In the microphone module provided by the present invention, by combining the sound transmitting hole with the annular protrusion having the passage, when the microphone module is impacted by a high-pressure water, since the pressure of the water is relieved by the sound transmitting hole, the vibration amplitude of the intermediate layer becomes small such that the water is prevented from impacting and destroying the intermediate layer, and the acoustic performance and waterproof performance of the module are guaranteed. At the same time, the water blocked by the intermediate layer may flow out of the module through the passage, the said simple module design makes the microphone module have a good waterproof ability and is adapted to the needs such as water washing.

In order to enable the sound transmitting hole 21 to have an ability of blocking a high-pressure water, the diameter of the sound transmitting hole 21 should not be too large, but if the sound transmitting hole 21 is too small, the sound transmission will be influenced and the acoustic performance of the microphone module will be influenced. Apparently, the diameter of the sound transmitting hole 21 has an optimum range, and is preferably 0.1-0.15 mm in the present embodiment.

Figure 3:
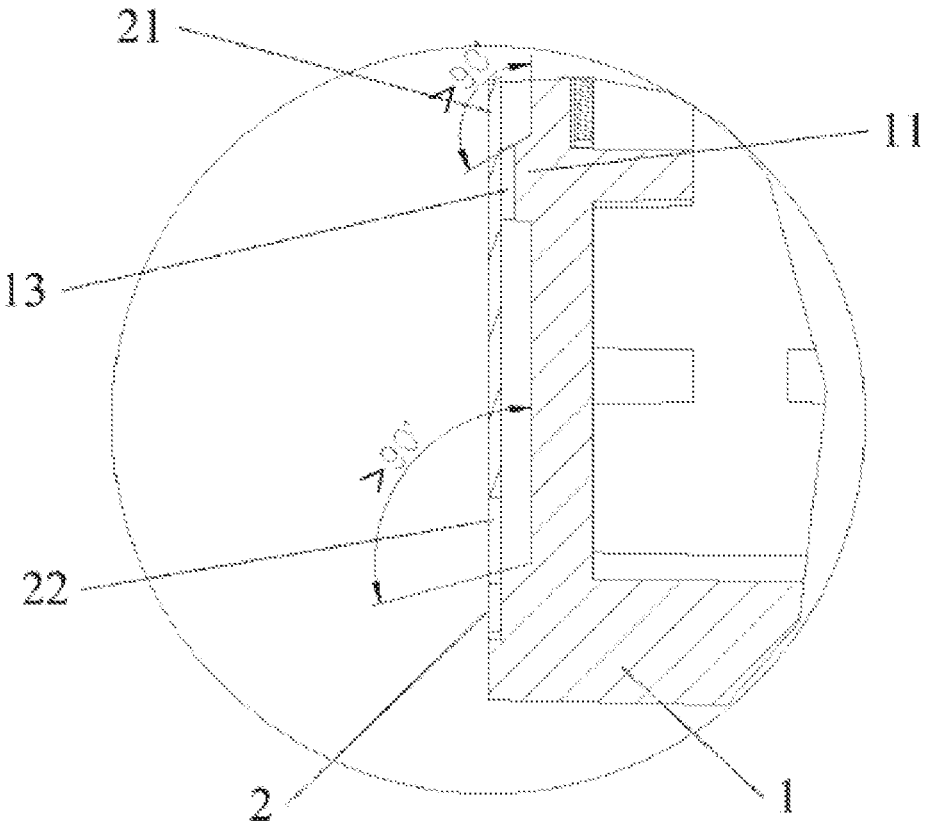
FIG. 3 illustrates an enlarged view of part A in FIG. 2.

Alternatively, the passage 13 may be formed in a variety of ways. As illustrated in FIG. 3, the passage 13 consists of a notch formed in the end surface, opposite to the housing 1, of the annular protrusion 11, and the notch penetrates through the inner and outer wall surfaces of the side wall of the annular protrusion 11. As a preferred solution of the present embodiment, in order to increase the water drain capacity of the passage 13, the bottom of the notch extends to the outer side surface of the housing 1.

Of course, the said passage 13 may be formed in other ways. For example, the passage 13 is formed by opening a through hole in the side wall of the annular protrusion 11, penetrating through the inner and outer side wall surfaces of the side wall of the annular protrusion 11. The function of the forming way is the same as that in the previous embodiment, which is thus not repetitively described herein.

In addition, the intermediate layer may be a waterproof film or a water absorbing medium layer, and the material of the waterproof sound transmitting film may be a hydrophobic material, the material of the water absorbing medium layer should have a strong water absorbing ability, or the intermediate layer may be a structural layer having a drain passage. As one skilled in the art knows, although the present invention has not exhausted all the possible structures or materials of the intermediate layer, it should be understood, however, that other structures with the same function as the intermediate layer of the present invention still belong to the scope of protection of the present invention without departing from the main concept of the present invention.

Figure 2:
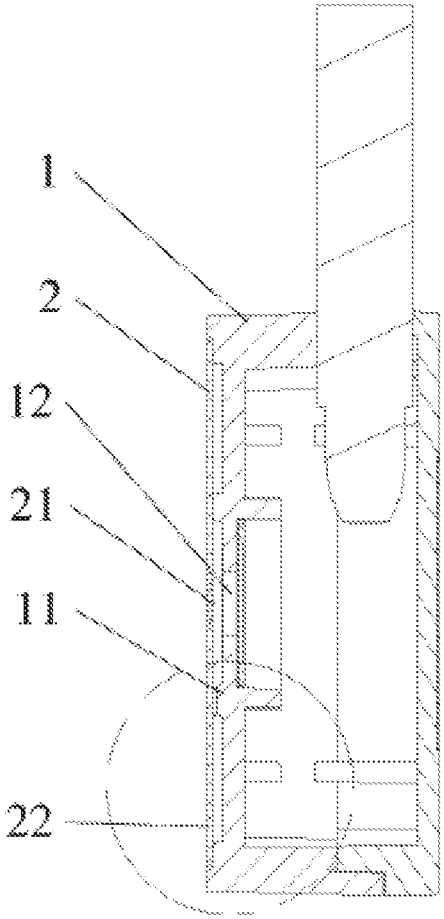
FIG. 2 illustrates a cross-sectional view of a microphone module in one embodiment provided by the present invention.

In addition, under the effect of gravity, in order to drain the water more thoroughly, the water drain hole 22 is located in the axial direction of the passage 13. It is well known in the field that, when the microphone module is placed as illustrated in FIG. 2, the water can be drained faster and more thoroughly.

Refer to FIG. 3, in order to prevent water droplets from remaining in the microphone module, the present invention provides a preferred embodiment, in which the side wall of the annular protrusion 11 has an inwards contracted structure and the surface of the inner side wall of the annular protrusion 11 is arranged as an inclined surface. The present embodiment utilizes the effect of gravity to design the side wall of the protrusion as a wedge-shaped structure illustrated in FIG. 3, which makes the water slides downwards front the first cavity along the inner side surface of the side wall, such that water droplets do not easily remain in the annular protrusion 11, the possibility that the water droplets enter the sound receiving hole 12 due to external forces such as shaking when the microphone is used is reduced, so the acoustic performance of the microphone module is prevented from being adversely influenced.

Same as the principle of the previous preferred embodiment, as illustrated in FIG. 3, the inner side wall surface of the cavity of the housing 1 corresponding to the water drain hole 22 is arranged as an inclined surface. Of course, the water drain hole 22 is located at the edge of the bottom of the pressing plate 2, such that the water droplets do not easily remain in the second cavity. It should be noted that, the water drain hole 22 in the present invention being located at the edge of the bottom the pressing plate 2 should be understood as that the edge of the bottom of the water drain hole 22 as illustrated in FIG. 3 is located on the outer side of the edge of the bottom of the inner side wall of the cavity of the corresponding housing 1, or at a flush position, which will not be repetitively described herein.

In addition, the present invention is not limited to the ways of the combination of the pressing plate 2 and the housing 1. However, as illustrated in FIG. 3, as a preferred solution, in order to make the combination of the housing 1 and the pressing plate 2 more firm, the inner side wall of the housing 1 combined with the pressing plate 2 may be formed as a step-shaped structure, and the side wall of the pressing plate 2 is combined and fixed with the inner side wall of the step-shaped structure, and the edge of the bottom of the pressing plate 2 is combined and fixed with the inner side bottom surface of the step-shaped structure. In addition, the combination and fixation mode is not limited to bonding or butting in the present invention. However, it should be noted that the improvement made without departing from the main concept of the present invention is still within the scope defined by the present invention.

Obviously, the above embodiments of the present invention are merely examples for clearly describing the present invention, rather than limitations on the embodiments of the present invention. For one skilled in the art, other different forms of changes or variations may be made on the basis of the above description. All embodiments cannot be exhausted herein. All obvious changes or variations derived from the technical solution of the present invention are still within the scope of protection of the present invention.

The invention claimed is:

1. A microphone module, wherein the module comprises:

a housing having a sound receiving hole;

a pressing plate fixedly combined with the housing, an accommodating cavity being formed between an inner side surface of the pressing plate and an outer side surface of the housing, and the pressing plate comprising a sound transmitting hole corresponding to the sound receiving hole; and an intermediate layer covering the sound receiving hole, provided on the outer or inner side surface of the housing, and corresponding to the sound receiving hole, wherein the housing further comprises an annular protrusion surrounding the sound receiving hole and extending outwards from the outer side surface of the housing, and an end surface, opposite to the housing, of the annular protrusion is fit to be fixed with the inner side surface of the pressing plate;

the annular protrusion divides the accommodating cavity into a first cavity formed inside the annular protrusion and a second cavity formed outside the annular protrusion;

the first cavity and the second cavity are communicated with each other through a passage in a side wall of the annular protrusion; and the pressing plate further comprises a water drain hole penetrating through the inner and outer side surfaces of the pressing plate, and the water drain hole is in communication with the second cavity.

2. The module according to claim 1, wherein the passage is formed by opening a through hole penetrating through inner and outer side wall surfaces of the side wall of the annular protrusion.

3. The module according to claim 1, wherein the passage consists of a notch formed in the end surface, opposite to the housing, of the annular protrusion, and the notch penetrates through inner and outer side wall surfaces of the side wall of the annular protrusion.

4. The module according to claim 3, wherein a bottom of the notch extends to the outer side surface of the housing.

5. The module according to claim 1, wherein the intermediate layer is a waterproof sound transmitting film or a water absorbing medium layer.

6. The module according to claim 1, wherein the pressing plate comprises a plurality of sound transmitting holes and the plurality of sound transmitting holes are correspondingly provided in an area defined by the annular protrusion.

7. The module according to claim 1, wherein the water drain hole is located in an axial direction of the passage.

8. The module according to claim 1, wherein the side wall of the annular protrusion has an inwards contracted structure and a surface of an inner side wall of the annular protrusion is arranged as an inclined surface.

9. The module according to claim 1, wherein the water drain hole is located in an edge of a bottom of the pressing plate and a surface of an inner side wall of the cavity of the housing corresponding to the water drain hole is arranged as an inclined surface.

10. The module according to claim 1, wherein the diameter of the sound transmitting hole is 0.1-0.15 mm.

* * * * *